US006035814A

United States Patent [19]

Christenson et al.

[11] Patent Number: 6,035,814

[45] Date of Patent: Mar. 14, 2000

[54] COMPOUND COMBUSTION EXPANSION INTERNAL COMBUSTION ENGINE

[76] Inventors: Howard W. Christenson, 128 W. 73rd St., Indianapolis, Ind. 46260; Roger C. Christenson, 11240 College Ave., Carmel, Ind. 46032

[21] Appl. No.: 09/185,302

[22] Filed: Nov. 3, 1998

[51] Int. Cl.[7] ..... F02B 75/04

[52] U.S. Cl. ..... 123/48 AA; 123/78 AA

[58] Field of Search ..... 123/48 R, 48 AA, 123/78 A, 78 AA

[56] References Cited

U.S. PATENT DOCUMENTS

| | | | |
|---|---|---|---|
| 1,467,734 | 9/1923 | MacLachlan | 123/48 A |
| 1,474,954 | 11/1923 | Brown | 123/78 A |
| 2,444,108 | 6/1948 | Norton | 123/48 AA |

*Primary Examiner*—Henry C. Yuen
*Assistant Examiner*—Hai Huynh

[57] ABSTRACT

An internal combustion engine in one embodiment includes a number of cylinders each having a crank piston connected to an engine crankshaft and disposed within a combustion chamber. Each cylinder includes a valve seat projecting inward from cylinder wall offset from the top dead center position of the crank piston. A free piston is slidingly disposed within the cylinder between the head end and the valve seat. The free piston has an outer diameter that is less than the inner diameter of the cylinder to permit leakage of combustion gas past the free piston. The free piston also includes a lower face opposing the crank piston with an annular groove defined in the lower face configured for sealing engagement with the valve seat. The free piston defines a pressure chamber that is pressurized during the by combustion process when the free piston is disposed apart from the valve seat.

21 Claims, 2 Drawing Sheets

COMPOUND COMBUSTION EXPANSION INTERNAL COMBUSTION ENGINE

BACKGROUND OF THE INVENTION

The present invention relates to internal combustion engines, such as spark ignition and diesel engines. More particularly, the invention contemplates systems and methods for accommodating accelerated combustion expansion within the engine, such as occurs with minimum temperature auto-ignition.

In an internal combustion engine, a charge of fuel is ignited to cause rapid expansion of the resulting gases. This rapid expansion drives the pistons connected to the engine crankshaft. In the case of a spark ignition engine, the fuel is first introduced into the cylinder, compressed by action of the crank piston, and then ignited by a spark plug or other similar ignition source. In the case of a diesel engine, air is compressed by the piston to a particular pressure, fuel is injected into the high-pressure environment under circumstances in which the fuel will automatically ignite.

In spark and compression ignition engines, detonation, or engine "knock", may occur. Detonation is due to auto-ignition of end gas, or the part of the charge that has not yet been consumed by ignition flame front. This auto-ignition occurs when the unburned end gas is compressed by expansion of the burned part of the air/fuel charge. As the end gas is compressed, its temperature increases to a point at which the end gas automatically ignites. Rapid auto-ignition in a small volume causes detonation, leading to a rapid pressure spike within the engine cylinder. This detonation pressure spike usually generates intense vibrations in the cylinder walls that can cause damage to the cylinder head and to the face of the piston. Thus, the detonation of the secondary fuel and gases has been regarded as anathema in the design of internal combustion engines.

Numerous attempts have been made in engine design to prevent detonation or engine knock. For example, reducing the amount of fuel injected into the cylinder can eliminate the occurrence of detonation, with the resulting loss of power output from the cylinder. Varying the timing or rate of the fuel injection relative to the cylinder stroke also helps alleviate the ping problem.

Another approach to reducing knock has been the development of premium ethyl gasoline. The premium gasoline slows the burn cycle so that substantially all of the fuel burns without auto-ignition. The premium gasoline helps eliminate many engine knock problems with little sacrifice of output power. One downside of premium fuels is the added expense over lower octane or hybrid fuels.

All of these approaches go toward the elimination of detonation within the internal combustion engine cylinder. Many of these approaches reduce the engine power output, although some have a lesser effect than other approaches. There is a need for an internal combustion engine that can either avoid auto-ignition, or readily embrace auto-ignition without detonation. There is also a need for such an engine that avoids the problems of detonation while augmenting the power output of the engine over conventional engines.

SUMMARY OF THE INVENTION

In order to address this need, the present invention contemplates an internal combustion engine that uses a free body piston to augment the power output from a cylinder to the crankshaft. In one embodiment, an engine cylinder includes a traditional powered or crank piston connected to the crankshaft. A free piston is disposed between the top-dead-center position of the crank piston and the cylinder head end. In its initial position, the free piston sealingly engages a valve seat to define a combustion volume between the free piston and the crank piston, and an accumulator pressure chamber behind the free piston.

In accordance with one aspect of the invention, the free piston slides freely within the cylinder and maintains a gap or running clearance between the free piston and cylinder wall. A single piston ring is disposed between the cylinder and free piston. This gap and single ring allow for blow-by of combustion gas from the combustion volume to the pressure chamber during acceleration when the free piston is unseated from the valve seat. When the free piston is sealingly engaged to the valve seat, the pressure in the pressure chamber is maintained or trapped at a working pressure value.

One feature of this embodiment is that the working pressure value is established at a pressure at or below which auto-ignition can normally occur in the particular engine. Until the combustion pressure exceeds this working pressure, the free piston remains seated on the valve seat. As the combustion pressure increases, the free piston unseats and moves upward to further compress the gas within the accumulator pressure chamber. The free piston unseats before or as minimum pressure auto-ignition commences, while free piston expansion maintains the rising working pressure by reducing the compression ratio, leaving no end gas pockets to detonate.

When the fuel is completely burned and combustion ends with a rounded pressure peak, the pressure within the combustion volume and pressure chamber peaks and then drops as the crank piston starts its downward stroke. At this point, maximum pressure drives the crank piston downward. In addition, the accumulator gas pressure acts on the free piston to push the gas column between the free piston and crank piston down until the free piston seats. This downward force returns all of the accumulated free piston energy to the crank piston before it reaches its exhaust position.

In the preferred embodiment of the invention, the free piston includes a recess communicating with the pressure chamber. The recess defines a pressure cavity in the free piston that increases the yield gas volume. The dimensions of the pressure cavity can be calibrated to achieve a predetermined volume and pressure behind the free piston when the piston is bottomed against the cylinder head end at the end of its upward stroke.

One feature of the invention is that it permits efficient expansion of the combustion volume during the combustion phase. This greater expansion volume minimizes or eliminates the likelihood of auto-ignition detonation in an internal combustion engine. Rapid yield of the free piston adiabatically achieves this valuable feature. Moreover, as the free piston yields, it stores expansion energy in the pressure chamber behind the free piston, while also increasing the combustion volume. This additional energy is returned to the crank piston after the fuel has substantially completely burned as the pressure behind the free piston drives it downward toward the crank piston until it seats.

The addition of the free piston in each engine cylinder allows for storage of combustion energy until all the fuel in the combustion chamber is burned. This feature can extend thermal power and combustion efficiency with less air pollution, while reducing the likelihood of engine knock.

The present invention allows the engine to capitalize on auto-ignition of the whole charge before detonation. With the present invention, the rapid combustion drives the free piston upward, further compressing the gas in the pressure chamber. This additional compression is then returned to the crank piston on the return stroke of the free piston.

In certain specific embodiments of the invention, as the spark ignition temperature in the combustion chamber between the crank piston and free piston exceeds the minimum auto-ignition temperature (e.g., 400° C.) the free piston accelerates with nominal pressure yield until all the fuel is burned below the detonation temperature (e.g., 600° C.), making detonation knock impossible. In addition, the rapid yield of the free piston produces a reduced compression ratio, which is better than the slow burn control of prior approaches.

With the present invention, minimum temperature auto-ignition always occurs at minimum temperature, so it is cushioned by free piston expansion before and after ignition eliminates all end gas pockets. This aspect leads to a smooth burn of all remaining fuel. The initial pressure at this event may be constant, while the ending pressure always occurs with minimum fuel at any pressure with only trace knock.

It is one object of the present invention to harness a greater percentage of the energy derived from combustion of fuels within the engine cylinder. A further object is accomplished by features of the invention that extend the engine combustion pressure cycle with substantially instant conversion expanding volume until the fuel is burned. Yet another object is to eliminate the engine knock or ping that has traditionally accompanied a detonation condition in a small volume engine cylinder.

One benefit of the embodiments of the present invention is that the internal combustion engines can store energy generated during combustion, and then return that energy to the crank piston during its downward stroke. A further benefit is achieved by aspects of the invention that permit easy integration into existing engine architecture or addition to an existing internal combustion engine.

An additional benefit resides in the ability of the free piston to yield at "gun" rates. This two-piston expansion is ideal for homogeneous stoichiometric fuel expansion, while only requiring regulation of the minimum pressure. Moreover, the lower temperature combustion of the fuel accomplished by the present invention, early in each cycle, will substantially reduce air pollution for all engine applications.

Other object and benefits of the present invention can be discerned from the following written description of the preferred embodiments and the accompanying figures.

DESCRIPTION OF THE PREFERRED EMBODIMENT

Figure 1:
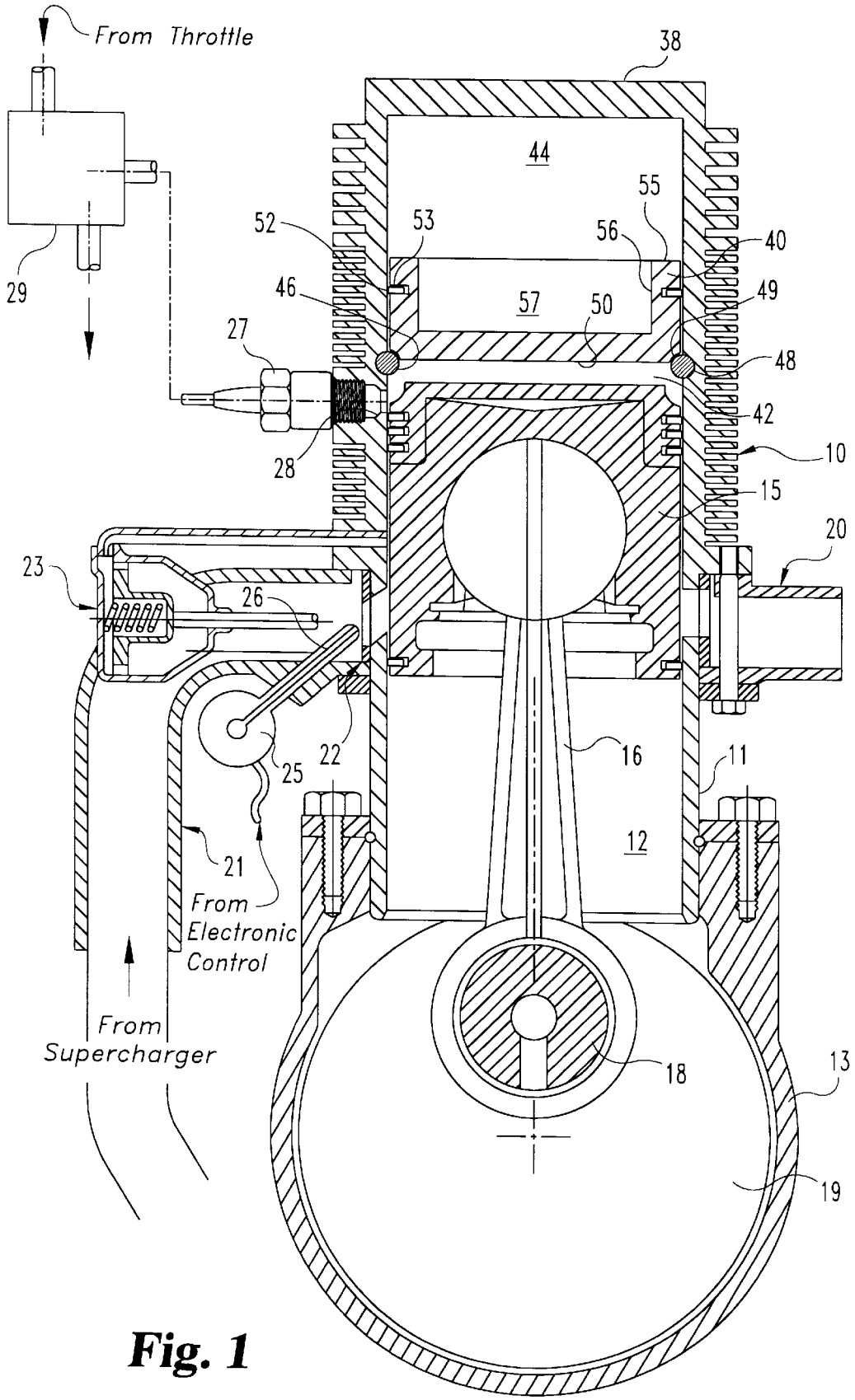
FIG. 1 is a side partial cross-sectional view of an engine cylinder utilizing a free piston apparatus according to one embodiment of the compound combustion expansion internal combustion engine of the present invention.

For the purposes of promoting an understanding of the principles of the invention, reference will now be made to preferred embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

The present invention relates to internal combustion engines and particularly to an apparatus and method for extracting power through compound combustion expansion. In the illustrated embodiment, the engine is described as a spark ignition engine in which a spark plug is used to ignite a fuel/air mixture within the engine cylinder. However, it is understood that the invention contemplates extended volume application to rapid yield compression ignition through the Diesel pressure range. The engine, cylinder and free piston assembly of the present invention transfers power from the combustion of the air/fuel mixture through both the crank piston and the free piston.

One cylinder of an internal combustion engine in accordance with one embodiment of the present invention is shown in FIG. 1. The engine 10 includes a cylinder 11 defining a combustion chamber 12. An engine crankcase 13 houses the crankshaft 18 and a flywheel 19. A standard piston 15 is connected to a connecting rod 16 by way of a spherical wrist pin in the illustrated embodiment. The connecting rod 16 is engaged to the crankshaft 18 in a standard manner.

The engine 10 includes an exhaust manifold 20 and an intake manifold 21 to provide for the intake of air into and the exhaust of combustion gases from the combustion chamber 12. The engine 10 includes a rotary valve assembly 22 that is controlled by a valve actuator 23 that opens and closes intake and exhaust ports of the crankcase 12. Details of the structure and operation of the rotary valve assembly can be found in U.S. Pat. No. 5,109,810, issued on May 5, 1992 to the present inventor, which description is incorporated herein by reference.

The engine further includes a fuel injector 25 that passes fuel through a nozzle 26 into the combustion chamber during an appropriate point in the engine cycle. A spark plug 27 is engaged at a port 28 near the top of the combustion chamber 12. An electronic control 29 is provided to control the fuel injector 25 and the activation of the spark plug 27. Alternatively, the fuel injector can be disposed in the region of the spark plug to produce a stratified charge.

In accordance with the present invention, a free piston 40 is disposed between the crank piston 15 and the closed head end 38 of the cylinder. The free piston 40 and the crank piston 15 define a combustion volume 42 when the free piston 40 is in its initial position depicted in FIG. 1. The chamber 12 defines a pressure chamber 44 behind the free piston 40, and particularly between the piston 40 and the cylinder head end 38. In accordance with one aspect of the present invention, the pressure chamber 44 stores pressurized combustion gas accumulated and trapped during the combustion cycle of the engine.

In one feature of the engine, a valve seat 46 is provided against which the free piston 40 rests at its initial position as shown in FIG. 1. The valve seat 46 is preferably a wire ring valve that is pressed into a groove 48 at the interior wall of the cylinder 11. An annular groove 49 is defined at the lower outer corner of the free piston 40 adjacent the lower face 50, as shown most clearly in the enlarged detail view of FIG. 2. In the illustrated embodiment, the valve seat 46 is a ring valve having a circular cross section. The groove 49 in free piston 40 is consequently formed as a quarter circle having a radius equal to the radius of the valve seat 46.

Figure 2:
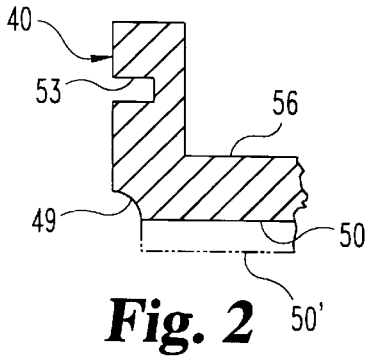
FIG. 2 is an enlarged cross-sectional view of a portion of the free piston depicted in FIG. 1, with an alternative configuration of the bottom face of the free piston shown in phantom lines.

In another specific embodiment, the lower face 50 of the free piston 40 can be extended beyond the quarter circle groove 49, such as the extended lower face 50' shown in FIG. 2. As the lower face 50' of the piston moves past the valve seat, a small volume of gas is trapped between the valve seat and the groove 49. This entrapped gas acts to dampen the downward movement of the free piston 40 as it seats on the valve seat 46. In a specific embodiment, this extended lower face 50' extends about 0.030 inches beyond the groove 49.

The valve seat 46 can have other cross-sections, with commensurate changes in the groove 49 in the free piston 40, provided that a gas-tight seal can be maintained when the piston 40 is seated on the valve seat 46. The valve seat ring 46 can be formed of steel or other materials suited for the high temperature environment of an engine cylinder.

In a further aspect of the present embodiment, a piston ring 52 is engaged within a ring groove 53 of the free piston 40. The ring 52 can be formed of standard material for piston rings, such as cast iron or metallized molybdenum. The piston ring 52 is provided to help stabilize the free piston 40 and to limit gas leakage as it translates within the combustion chamber 12. It is contemplated that the piston ring 52 will permit the passage of some combustion gas into the pressure chamber 44 during the accelerating combustion cycle.

In a specific embodiment, the outer diameter of the free piston 40 is approximately three times the height of the piston. Diameter to height ratios of this degree are sufficient to prevent the free piston from self-locking during its performance stroke. It is also contemplated that the free piston be formed from an alloy steel that can be coated with a molybdenum sulfate to provide improved wear resistance. However, since the free piston 40 moves as a free body within the pressure chamber 44, it is anticipated that no side loads and only minimal frictional loads will be encountered.

Figure 3:
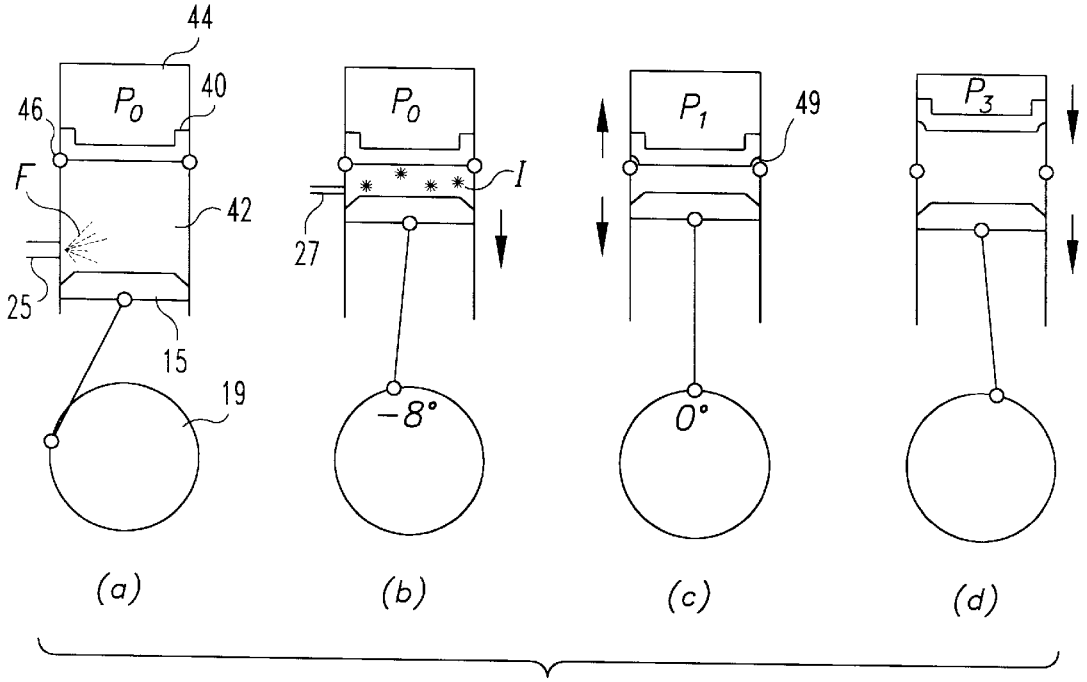
FIG. 3 is a schematic view of the engine cylinder shown in FIG. 1 at sequential stages in the combustion cycle of the engine according to the present invention.

The operation of the engine 10, and particularly the free piston 40, is depicted in the sequential diagrams shown in FIG. 3. The sequence shown in the FIGS. is principally for light throttle operation below about 600 p.s.i. The timing of the events depicted in these sequential diagrams will vary for higher throttle operation of the engine. It is understood that the illustrations of FIGS. 3 depict a spark-ignition engine and the combustion cycle for such an engine.

As shown in the initial diagram of FIGS. 3(*a*), the crank piston 15 is connected to the flywheel 19 and is positioned at about 70° prior to top dead center. In this position, the free piston 40 is at its initial position resting on the valve seat 46. At this initial state, the pressure chamber 44 is filled with pressurized accumulator gas that had been generated in prior combustion cycles. This gas is at an initial pressure $P_0$, which is greater than atmospheric pressure, but less than the pressure generated during combustion of the fuel/air mixture within the combustion volume 42. In this position, the pressure $P_0$ is greater than the pressure within the combustion volume 42, so that the free piston 40 is urged in a sealing relationship with the valve seat 46.

In accordance with the present invention, the initial pressure $P_0$ of the pressure chamber 44 behind the free piston 40 can be based upon the anticipated auto-ignition pressure within the combustion volume 42. In one specific embodiment of the invention, this pressure $P_0$ is below the auto-ignition pressure, and can be in the range of 400–600 psi. This pressure value varies depending upon the engine performance characteristics, and the expected auto-ignition expansion pressure.

In the initial step shown in FIG. 3(*a*), a quantity of fuel F is sprayed into the combustion volume 42 by the fuel injector 25. As the crank piston 15 continues in its upward stroke, it reaches a point, typically about 25° before top dead center, at which the air/fuel mixture within the combustion volume 42 is ignited by the spark plug 27. In the specific embodiment, this position can be at 30° prior to T.D.C., although the ignition timing can be adjusted for maximum power. This ignition, designated I in FIG. 3(*b*), generates rising combustion pressure that drives the crank piston 15 downward. The combustion pressure should reach its peak at about 15° after T.D.C. as most of the fuel charge is exhausted.

In the next stage depicted in FIGS. 3(*c*), the pressure within the combustion volume 42 increases as the fuel burns until the pressure is sufficient for minimum pressure auto-ignition and to overcome the pressure $P_0$ behind the free piston 40. At this point, the free piston lifts off the valve seat ring 46, thereby compressing the gas in the pressure chamber 44 to a pressure $P_1$. As combustion continues within the combustion chamber 42, the pressure increases to drive the free piston further upward into the pressure chamber 44.

Once all of the fuel in the combustion chamber has burned, the free piston 44 and crank piston 15 move to the general relative positions shown in FIG. 3(*d*). After the fuel has burned, excess oxygen in the combustion chamber incinerates all of the carbon and residual fuel as the free piston coasts to a stop. At this point, the pressure of all the gas has increased to a value $P_3$.

The gas in the pressure chamber 44 expands to drive the free piston 40 downward against the gas column within the combustion chamber. This return or "bounce" movement of the free piston returns energy adiabatically to the crank piston until the free piston reseats against the valve seat 46, trapping pressure $P_0$ in the chamber 44.

Pressure in the pressure chamber 44 is maintained by leakage of combustion gases from the expanding combustion volume 42 past the free piston 40 and piston ring 52. This combustion gas blow-by helps charge the pressure chamber 44 to maintain the initial pressure $P_0$. In one specific embodiment, the initial pressure can be regulated to prevent free piston yield at light throttle. Increases in throttle can increase combustion pressure within the combustion chamber to exceed the initial pressure $P_0$ within the pressure chamber.

In the embodiment of the invention shown in FIG. 1, the upward travel of the free piston 40 is limited only by the pressure of the gas within the pressure chamber 44. One feature of the invention permits a consistently repeatable pressure $P_0$ within the pressure chamber since the chamber is maintained by blow-by gases from the combustion volume 42. Since the return stroke of the free piston 40 is constant, the pressure $P_0$ when the free piston is at its initial position (FIG. 3(*a*)) will be substantially the same cycle after cycle.

In some embodiments, such as shown in FIG. 1, the pressure chamber 44 can be augmented by a recess 56 defining a pressure cavity 57. The pressure cavity 57 increases the volume of the pressure chamber 44 during operation of the free piston 55.

The pressure cavity 57 provides a fixed volume for the pressurized gas behind the free piston 55. The size or volume of the pressure cavity 57 can be predetermined to establish a fixed pressure if the free piston 55 bottoms in its upward travel against the cylinder head 38. Alternatively, the combined volume of the pressure cavity 57 and pressure chamber 44 can be sized to achieve a predetermined repeatable initial pressure without bottoming the free piston.

In an alternative embodiment, the piston 40 can be solid, thereby eliminating the recess 56 and pressure cavity 57. The solid free piston can increase the mass pressure regulation characteristics of the free piston. With this configuration, the piston will never bottom against the cylinder head 38.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected.

For example, in one modification, the pressure $P_0$ in the pressure chamber 44 can be controlled by a pressure regulator mounted in the cylinder wall 11 or in the head end 38. The pressure regulator can constitute a pop-off valve that bleeds gas from the chamber 44 until the pressure drops to the calibrated value. The pressure regulator could be deactivated when the free piston 40 lifts off the valve seat 46, so that the pressure within the chamber 44 can increase and ultimately return work to the crank piston.

The more rapid combustion energy of homogeneous auto-ignition combustion expansion can be stored by adiabatic direct conversion gas compression at any rate, and the free piston mass acceleration yields at force time rates. The addition of the free piston with ample pre-loaded gas cushion can yield at auto-ignition pressures until all the fuel is burned with adiabatic instant work conversion to mass velocity and accumulator gas compression. The usable peak accumulator pressure (which can be in the range of 800–1200 p.s.i.) transfers all the energy to the crank piston as smooth as a steam cycle.

Excess oxygen at peak temperature incinerates all the carbon and residual fuel before the flame front is extinguished, as the free piston coasts to a stop. It is significant that the free piston lifts off its seat so that the additional pressure chamber volume can reduce the combustion expansion compression ratio, making knock substantially impossible. The free piston minimum or initial pressure can be regulated to any desirable pressure split for maximum efficiency with trace knock in the Diesel pressure range. The increased free piston gas cushion limits the pressure rise rate to a rounded peak as the charge runs our of fuel, again making knock nearly impossible for the near homogeneous stoichiometric air-fuel charge.

The free piston of the present invention can be added to any engine with available space at the cylinder head. The addition of the present invention will increase combustion speed and expansion ratio for greater engine efficiency and lower air pollution. It is anticipated that primary Otto cycle combustion will also be benefited by the present invention to reduce air pollution, especially during light throttle operation. Compound expansion provided by the added free piston will also provide maximum performance and efficient squeeze power at higher pressure cruising.

What is claimed is:

1. In combination with an internal combustion engine having at least one cylinder with a head end and defining a combustion chamber, and further having a crank piston connected to an output shaft for reciprocation within the cylinder between a top-dead-center (TDC) position and a bottom-dead-center (BDC) position, the improvement comprising:

a valve seat projecting inward from the cylinder offset from the TDC position of the crank piston, said valve seat having an inner diameter less than the inner diameter of the cylinder between the head end and said valve seat; and a free piston slidably disposed within the cylinder between the head end of the cylinder and said valve seat, said free piston having an outer diameter smaller than the inner diameter of the cylinder to permit passage of gases generated in the combustion chamber past said free piston but greater than said inner diameter of said valve seat, said piston having a lower face opposing the crank piston and defining a portion at said lower face configured for sealing engagement with said valve seat, whereby said free piston defines a pressure chamber between said free piston and the head end of the cylinder, said pressure chamber being pressurized by combustion gases passing between said free piston and the cylinder when said free piston is disposed apart from said valve seat, the pressure within said pressure chamber being maintained when said free piston is seated on said valve seat.

2. The improvement according to claim 1, wherein said free piston includes a groove defined at said outer diameter and a piston ring disposed within said groove.

3. The improvement according to claim 1, wherein said free piston has a height dimension perpendicular to said outer diameter of said free piston that is between approximately one-third and one-fourth of said outer diameter.

4. The improvement according to claim 1, wherein said valve seat includes a groove defined in the cylinder and a ring sized to fit partially within said groove.

5. The improvement according to claim 4, wherein said ring has a circular cross section defined at a ring radius and said portion of said free piston includes an annular groove defined as a quarter circle at said ring radius.

6. The improvement according to claim 5, wherein said lower face of said free piston extends below said quarter circle of said annular groove.

7. The improvement according to claim 1, wherein said free piston has an upper face opposite said lower face and a recess defined in said upper face defining a pressure cavity in communication with said pressure chamber.

8. The improvement according to claim 7, wherein said free piston has a stroke from an initial position engaged on said valve seat to a peak position bottomed against the head end of the cylinder, and said stroke is approximately one-fourth of the travel of the crank piston between TDC and BDC.

9. The improvement according to claim 1, wherein the cylinder has an initial compression ratio of twelve to one (12:1).

10. The improvement according to claim 1, further comprising a pressure regulator in fluid communication with said pressure chamber and calibrated to maintain a predetermined minimum pressure within said pressure chamber.

11. The improvement according to claim 10, wherein said predetermined minimum pressure is less than the pressure at which auto-ignition occurs within the combustion chamber for the engine.

12. The improvement according to claim 1, wherein said valve seat is arranged within the cylinder so that said pressure chamber defines a volume when said free piston is seated on said valve seat that is approximately one-fourth the volume of the combustion chamber between the TDC and BDC positions of the crank piston.

13. An internal combustion engine comprising:

at least one hollow cylinder closed at a head end and defining a combustion chamber;

a crank piston connected to an engine crankshaft and disposed within said combustion chamber of said hollow cylinder to reciprocate between a top-dead-center (TDC) position and a bottom-dead-center position (BDC);

an air intake valve assembly configured for introducing air into said combustion chamber;

an exhaust valve assembly configured to exhaust combustion gases from said combustion chamber;

a fuel introducer apparatus configured to introduce fuel into said combustion chamber;

a valve seat projecting inward from said hollow cylinder offset from the TDC position of said crank piston, said valve seat having an inner diameter that is less than the inner diameter of said cylinder between said head end and said valve seat;

a free piston slidingly disposed within said cylinder between said head end and said valve seat, said free piston having an outer diameter that is less than said inner diameter of said cylinder to permit passage of combustion gases past said free piston but greater than said inner diameter of said valve seat, said free piston having a lower face opposing said crank piston and a portion at said lower face configured for sealing engagement with said valve seat, whereby said free piston defines a pressure chamber between said free piston and said head end, said pressure chamber being pressurized by combustion gases passing between said free piston and said cylinder when said free piston is disposed apart from said valve seat, the pressure within said pressure chamber being maintained when said free piston is seated on said valve seat.

14. The internal combustion engine according to claim 13, wherein said free piston has an upper face opposite said lower face and a recess defined in said upper face defining a pressure cavity in communication with said pressure chamber.

15. The internal combustion engine according to claim 13, further comprising a spark ignition device mounted within said cylinder adjacent said TDC position of said crank piston.

16. The internal combustion engine according to claim 13, wherein said valve seat is arranged so that said lower face of said free piston is disposed apart from said crank piston when said free piston is seated on said valve seat.

17. The internal combustion engine according to claim 13, wherein said valve seat is arranged within said cylinder so that said pressure chamber has a volume that is approximately one-fourth of the volume of the combustion chamber between the TDC and BDC positions of said crank piston.

18. The internal combustion engine according to claim 13, wherein:

said valve seat includes a groove defined in said cylinder and a ring sized to fit partially within said groove, said ring being circular at a ring radius and defining said inner diameter of said valve seat; and said portion of said free piston includes an annular groove defined as a quarter circle at said ring radius.

19. The internal combustion engine according to claim 18, wherein said lower face of said free piston extends below said quarter circle of said annular groove.

20. A method for generating power from an internal combustion engine, comprising the steps of:

providing a valve seat within the engine cylinder adjacent the top-dead-center position of the crank piston;

providing a free piston slidingly disposed within the cylinder between the valve seat and the head end of the cylinder, the free piston configured to seat in sealing engagement with the valve seat to define a pressure chamber between the free piston and the head end, and sized so that combustion gas can pass between the free piston and the cylinder wall when the free piston is unseated from the valve seat;

charging the pressure chamber with pressurized gas generated during combustion of an air-fuel mixture between the free piston and the crank piston;

adjusting the initial pressure within the pressure chamber when the free piston is seated on the valve seat so that the free piston remains seated on the valve seat during a portion of the combustion phase but is displaced from the valve seat when the pressure within the combustion chamber exceeds the initial pressure, wherein the initial pressure is less than peak combustion pressure within the combustion chamber, so that energy from combustion is stored as gas in the pressure chamber is compressed by movement of the free piston as the pressure within the combustion chamber increases from the initial pressure to the peak pressure; and returning the stored energy within the pressure chamber by expansion of the gas within the pressure chamber after combustion ceases.

21. In combination with an internal combustion engine having at least one cylinder with a head end and defining a combustion chamber, and further having a crank piston connected to an output shaft for reciprocation within the cylinder between a top-dead-center (TDC) position and a bottom-dead-center (BDC) position, the improvement comprising:

a valve seat projecting inward from the cylinder offset from the TDC position of the crank piston, said valve seat having an inner diameter less than the inner diameter of the cylinder between the head end and said valve seat; and a free piston slidably disposed within the cylinder between the head end of the cylinder and said valve seat, said free piston having an outer diameter smaller than the inner diameter of the cylinder for running clearance, said piston having a lower face opposing the crank piston and defining a portion at said lower face configured for sealing engagement with said valve seat, whereby said free piston defines a pressure chamber between said free piston and the head end of the cylinder, said pressure chamber being pressurized by combustion gases passing between said free piston and the cylinder when said free piston is disposed apart from said valve seat during rapid combustion acceleration, the pressure within said pressure chamber being maintained when said free piston is seated on said valve seat.

* * * * *